US010175711B1

(12) United States Patent
Petruzzi et al.

(10) Patent No.: US 10,175,711 B1
(45) Date of Patent: Jan. 8, 2019

(54) BANDGAP CURVATURE CORRECTION

(71) Applicant: Infineon Technologies AG, Neubiberg (DE)

(72) Inventors: Luca Petruzzi, Goedersdorf (AT); Anthony Candage, Meredith, NH (US)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 15/699,055

(22) Filed: Sep. 8, 2017

(51) Int. Cl.
*G05F 3/26* (2006.01)

(52) U.S. Cl.
CPC ..... *G05F 3/262* (2013.01)

(58) Field of Classification Search
None
See application file for complete search history.

(56) References Cited

U.S. PATENT DOCUMENTS 5,952,873 A 9/1999 Rincon-Mora
6,642,699 B1 * 11/2003 Gregoire, Jr. ..... G05F 3/30 323/314
7,696,909 B2 * 4/2010 Oberhuber ..... G05F 3/30 327/307
8,344,720 B2 * 1/2013 Nag ..... G05F 3/16 323/315
8,710,898 B1 4/2014 Chiang et al.

OTHER PUBLICATIONS

"Flexible Power Management Unit," Infineon, IRPS5401, Jun. 21, 2016, 7 pp.
Rincon-Mora, et al., "A 1.1 V Current-Mode and Piecewise-Linear Curvature Corrected Bandgap Reference," IEEE J. Solid-State Circuits, vol. 10, Oct. 1998, 16 pp.

* cited by examiner

*Primary Examiner* — Jeffery S Zweizig
(74) *Attorney, Agent, or Firm* — Shumaker & Sieffert, P.A.

(57) ABSTRACT

In some examples, a device includes a curvature-correction circuit including a first current source configured to generate a PTAT electrical current. In some examples, the curvature-correction circuit also includes three or more programmable current sources configured to generate three or more programmable electrical currents. In some examples, the curvature-correction circuit is configured to generate a PWL electrical current based on the PTAT electrical current and the three or more programmable electrical currents. In some examples, the device also includes a reference voltage circuit configured to generate a reference voltage signal based on the PWL electrical current.

20 Claims, 9 Drawing Sheets

BANDGAP CURVATURE CORRECTION

TECHNICAL FIELD

This disclosure relates to bandgap reference voltage circuits.

BACKGROUND

Bandgap reference voltage circuits are used in integrated circuits in a broad range of applications. Bandgap reference voltage circuits provide a reference voltage, typically around 1.2 volts, over a wide temperature range, e.g. between negative forty degrees Celsius and positive one hundred and twenty-five degrees Celsius. The overall accuracy of the output voltage of a bandgap reference voltage circuit may be influenced by several factors, such as process variation, device mismatch, and temperature dependency, also known as bandgap curvature or temperature-dependent curvature.

Applications in which a bandgap voltage is used as reference of precise control and regulation loops, such as direct-current-to-direct-current (DC/DC) converters, may need a voltage accuracy of 0.5% from negative forty degrees Celsius and positive one hundred and twenty-five degrees Celsius. The temperature-dependent curvature of the bandgap voltage is a significant source of error, contributing for 0.13% to the overall inaccuracy of the bandgap voltage. While the effect of process variation can be reduced by trimming or offset cancellation techniques, the bandgap reference voltage circuit may need a specific circuit to address the error introduced from the temperature-dependent curvature. However, even reducing the error due to process variation and device mismatch, achieving an overall accuracy of 0.5% across a broad range of temperatures may be difficult or uneconomical, if the error related to the bandgap curvature remains.

SUMMARY

This disclosure describes techniques for correcting the temperature-based curvature of a reference voltage signal. In some examples, a curvature-correction circuit is configured to generate a piecewise-linear (PWL) electrical current to correct the curvature of the reference voltage. The curvature-correction circuit may be configured to generate the PWL electrical current based on a proportional-to-absolute-temperature (PTAT) electrical current and three or more programmable electrical currents. In some examples, the trigger temperatures and/or electrical-current-to-temperature slopes of the programmable electrical currents may be programmable. In addition, the number of active programmable current sources may also be programmable.

In some examples, device includes a curvature-correction circuit including a first current source configured to generate a PTAT electrical current. The curvature-correction circuit also includes three or more programmable current sources configured to generate three or more programmable electrical currents. The curvature-correction circuit is configured to generate a PWL electrical current based on the PTAT electrical current and the three or more programmable electrical currents. The device also includes a reference voltage circuit configured to generate a reference voltage signal based on the PWL electrical current.

In some examples, a method includes generating a PTAT electrical current and generating three or more programmable electrical currents. The method further includes generating a PWL electrical current based on the PTAT electrical current and the three or more programmable electrical currents. The method also includes generating a reference voltage signal based on the PWL electrical current.

In some examples, a device includes a curvature-correction circuit including a first current source configured to generate a PTAT electrical current and three or more programmable current sources configured to generate three or more programmable electrical currents. The curvature-correction circuit also includes three or more switches, wherein each switch of the three or more switches is electrically connected in series with a respective programmable current source of the three or more programmable current sources. The curvature-correction circuit is configured to generate a piecewise-linear (PWL) electrical current based on the PTAT electrical current and the three or more programmable electrical currents. The device further includes a reference voltage circuit configured to generate a reference voltage signal based on the PWL electrical current. The device includes a control circuit configured to turn off each programmable current source of the three or more programmable current sources by at least disabling a respective switch of the three or more switches below a trigger temperature for the respective programmable current source. The trigger temperature of each programmable current source of the three or more programmable current sources is programmable.

The details of one or more examples are set forth in the accompanying drawings and the description below. Other features, objects, and advantages will be apparent from the description and drawings, and from the claims.

DETAILED DESCRIPTION

This disclosure describes a device and a method for generating a reference voltage signal such as a bandgap reference voltage. In some examples, the reference voltage signal generated by the circuit may vary with temperature (e.g., the bandgap curvature). To correct the temperature-dependent variation or curvature, the circuit may generate a reference voltage signal based on a piecewise linear (PWL) electrical current that is sized to match the curvature of an uncorrected reference voltage signal. The circuit may generate the PWL electrical current by controlling three or more programmable current sources.

The device may output a corrected reference voltage signal with less temperature-dependence than the reference voltage signals generated by other devices. For example, the programmable current sources of this disclosure may include one or more programmable parameters, such as trigger temperatures and/or slopes. The number of programmable current sources that are active at any time may also be programmable. The programming of the current sources may occur in response to a production test or in the field during operation. The programmable current sources may allow for close matching of the curvature of a curvature-correction (CC) electrical current to the temperature-dependent curvature of an uncorrected reference voltage signal.

The programmable current sources may compensate for process variations and mismatches in manufacturing process. For example, because every device that leaves the factory may be different, a customizable approach including programmable current sources may be flexible enough to account for the differences in each individual device. A tester at the factory or in the field, or an on-chip embedded digital circuit, may program the current sources to match the unique temperature-dependent curvature of the uncorrected reference voltage signal of each device.

The accuracy of a reference voltage signal may be very important to devices such as power conversion circuits, including point of load direct-current-to-direct-current (DC/DC) converter circuits. Achieving a product specification, such as an accuracy of 0.5% or 1.0% for a reference voltage signal, can be important for designing power conversion devices. The techniques of this disclosure may improve the accuracy of a reference voltage signal by up to thirty percent over a wide range of temperatures, as compared to existing techniques. In some examples, using a pure complementary metal-oxide semiconductor (CMOS) circuit, rather than bipolar transistors, may produce better substrate noise immunity and more trimming flexibility. In addition, the circuits described herein include one or more proportional-to-absolute-temperature (PTAT) electrical current sources and temperature-constant electrical current sources that may already be available on-chip.

Figure 1:
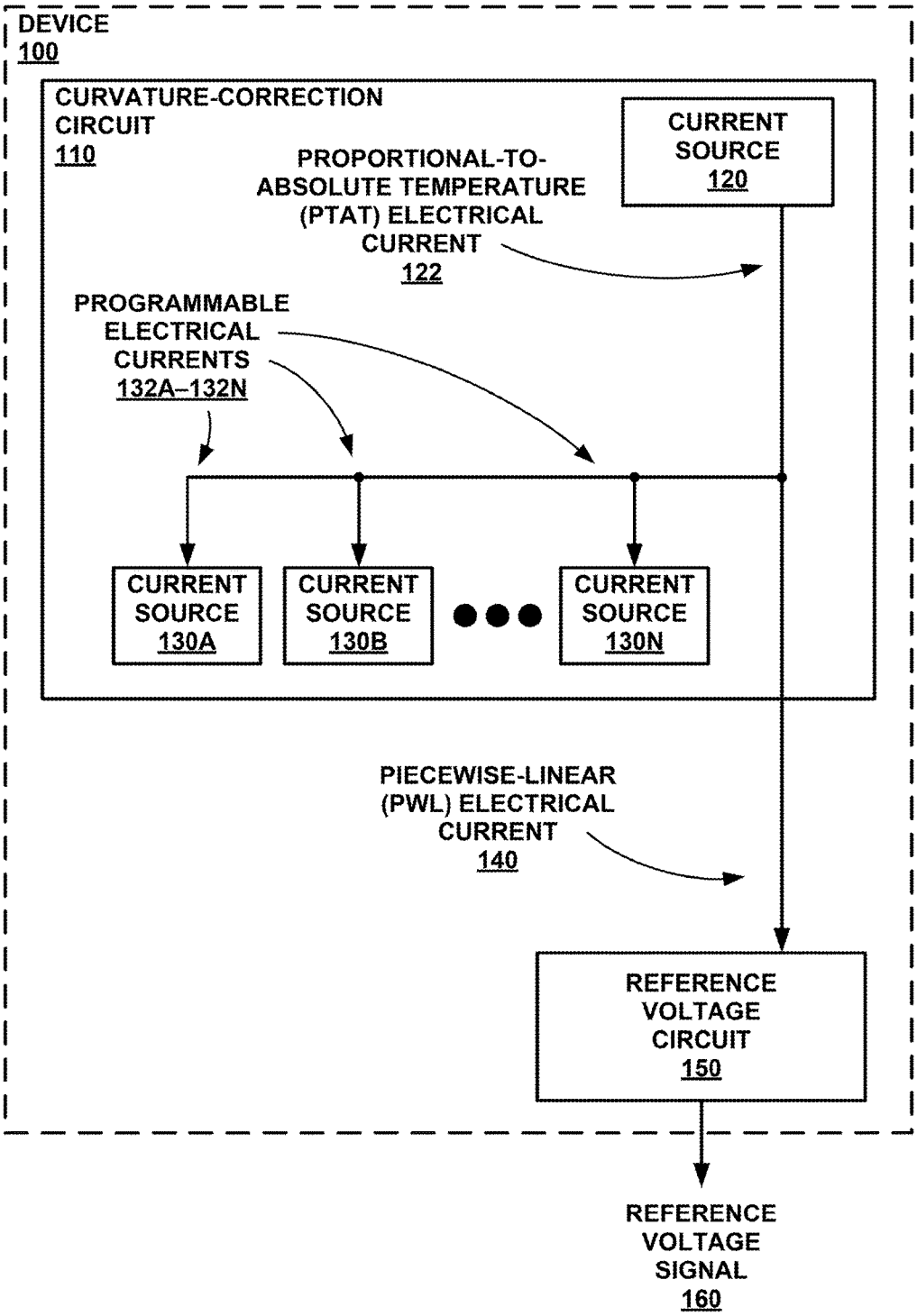
FIG. 1 is a conceptual block diagram illustrating a device configured to generate a reference voltage signal, in accordance with some examples of this disclosure.

FIG. 1 is a conceptual block diagram illustrating a device 100 configured to generate a reference voltage signal 160, in accordance with some examples of this disclosure. As depicted in FIG. 1, device 100 includes curvature-correction circuit 110, including current sources 120 and 130A-130N, and reference voltage circuit 150. Device 100 may also include or be connected to other components and circuits not depicted in FIG. 1, such as a power conversion circuit, a control circuit, and so on. For example, a power conversion circuit may receive reference voltage signal 160 for use in setting the desired output voltage of a DC/DC converter circuit, shutting off the device in case of a temperature hazard, and/or setting a frequency of an oscillator.

Curvature-correction circuit 110 may be configured to generate PWL electrical current 140 based on PTAT electrical current 122 and programmable electrical currents 132A-132N. Curvature-correction circuit 110 may include a power-supply node configured to receive a power-supply voltage signal (e.g., $V_{CC}$) and a ground node configured to receive a voltage signal such as reference ground.

Current source 120 is configured to generate PTAT electrical current 122. The amplitude of PTAT electrical current 122 may be proportional to absolute temperature. PTAT electrical current 122 may include a positive slope of electrical current to temperature such that the amplitude of PTAT electrical current 122 increases as the temperature of current source 120 increases. Each current source of current sources 120 and 130A-130N may include a current mirror with a constant aspect ratio or a programmable aspect ratio. In some examples, current sources 120 and 130A-130N may include MOS current mirrors configured to conduct electrical currents 122 and 132A-132N.

Programmable current sources 130A-130N are configured to generate programmable electrical currents 132A-132N. In some examples, each of programmable current sources 130A-130N may include a programmable trigger temperature and/or a programmable slope. Each of programmable current sources 130A-130N may also be selectively connected or disconnected from curvature-correction circuit 110, such that the number of programmable current sources 130A-130N is adjustable. The electrical current of each of programmable current sources 130A-130N may have a constant amplitude over temperature or an amplitude that is proportional to absolute temperature. An electrical current with a constant amplitude over temperature may be referred to as a "constant-over-temperature electrical current." An electrical current with an amplitude that is proportional to absolute temperature may be referred to as a "PTAT electrical current."

PWL electrical current 140 may include a curvature that approximates the curvature of an uncorrected voltage signal. PWL electrical current 140 may include linear segments for two or more temperature ranges. Each of the linear segments may have endpoints at the trigger temperatures of programmable current sources 130A-130N, as shown for electrical current 440 in FIG. 4. In some examples, curvature-correction circuit 110 may process PWL electrical current 140 before curvature-correction circuit 110 delivers PWL electrical current 140 to reference voltage circuit 150. For example, curvature-correction circuit 110 may be configured to offset or change the amplitude of PWL electrical current 140. In addition, curvature-correction circuit 110 may be configured to amplify or attenuate a range of amplitudes of PWL electrical current 140 to match an uncorrected reference voltage signal.

Reference voltage circuit 150 may be configured to generate reference voltage signal 160 based on PWL electrical current 140. Reference voltage circuit 150 may be configured to subtract PWL electrical current 140 from an uncorrected reference voltage signal to generate reference voltage signal 160. Reference voltage circuit 150 may be configured to subtract PWL electrical current 140 by conducting PWL electrical current 140 through a wire or a shunt resistor.

Figure 2:
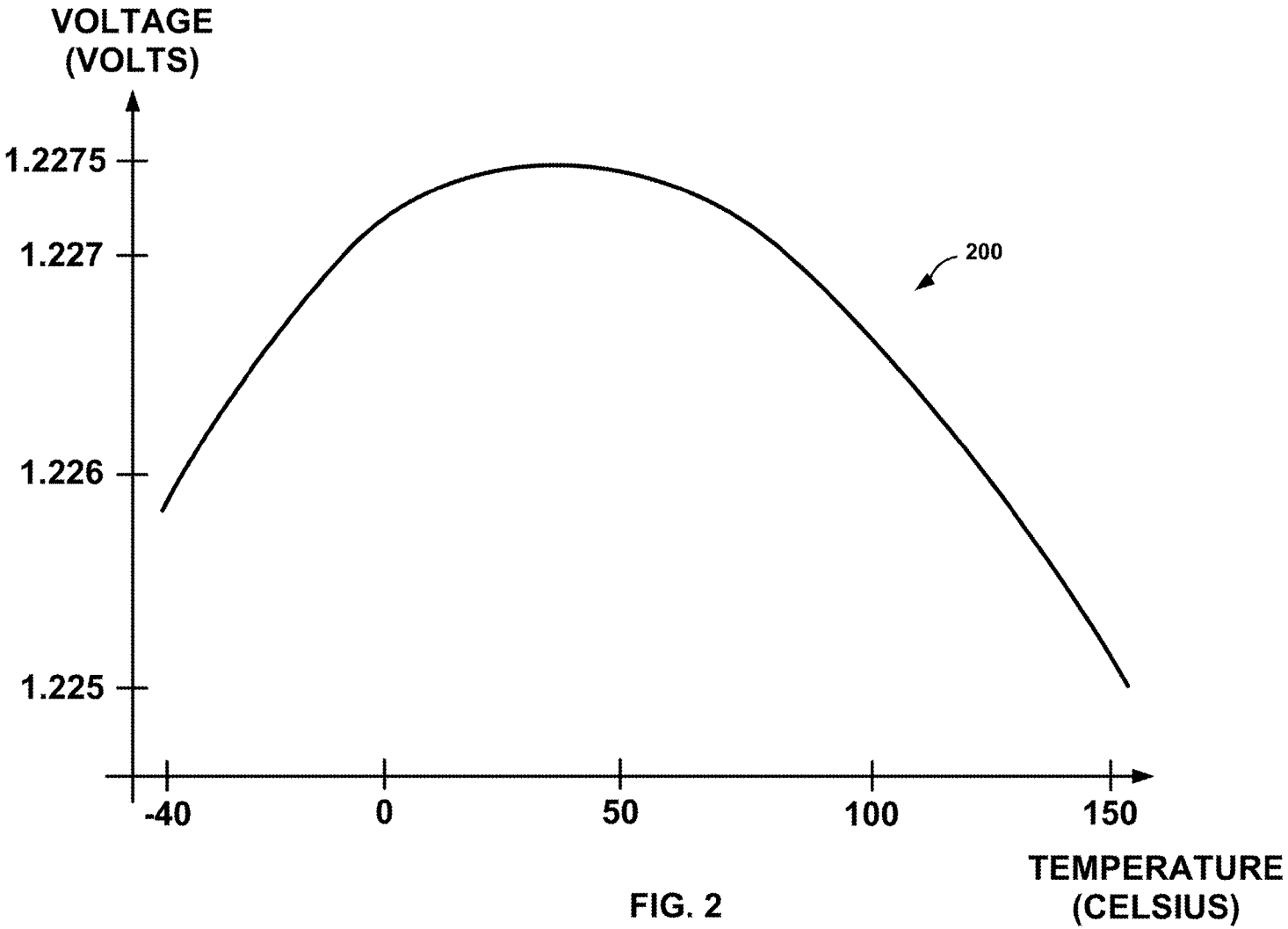
FIG. 2 is a graph of the temperature-based curvature of an uncorrected reference voltage signal, in accordance with some examples of this disclosure.

FIG. 2 is a graph of the temperature-based curvature of an uncorrected reference voltage signal 200, in accordance with some examples of this disclosure. Depending on the application, the curve of uncorrected reference voltage signal 200 may not be relevant at temperatures above one hundred and twenty degrees Celsius or one hundred and fifty degrees Celsius. In some examples, uncorrected reference voltage signal 200 may have a variation of 2.5 millivolts across a temperature range from minus forty degrees Celsius to one hundred and fifty degrees Celsius. Thus, the total variation may be more than 0.2% for an average voltage level of 1.226 volts or 1.227 volts.

In the example of FIG. 2, the curvature of uncorrected reference voltage signal 200 is a significant source of error, accounting for approximately 0.13% of the overall inaccuracy. While the effect of process variation can be reduced making use of trimming or offset cancellation techniques, the error introduced from the curvature compensation needs to be addressed by specific circuits. However, even reducing the error due to process variation and device mismatch, achieving an overall accuracy of approximately 0.5% over temperature might be either not possible or non-economical, if the error related to the bandgap curvature is not reduced. The techniques of this disclosure deals may reduce the curvature-induced error in a bandgap reference voltage with limited area occupation and little or no increase in cost. Using three or more programmable current sources to generate a PWL electrical current and/or a CC electrical current may be an economical way to correct bandgap curvature.

Another device may be configured to generate a voltage-controlled electrical current that is approximately proportional to the difference between an uncorrected reference voltage signal and the desired reference voltage signal. The other device may include one or more p-type bipolar transistors configured to supply a CC electrical current that will allow the generation of an almost temperature-independent reference voltage signal. However, bipolar transistors may have a greater temperature dependency and process variation than MOS transistors.

Another device may be configured to generate a CC electrical current by summing a positive temperature coefficient electrical current with a negative temperature coefficient electrical current. The other device may be configured to provide the negative temperature coefficient current only for temperatures above positive thirty-five degrees Celsius, and the CC electrical current will increase from minus forty degrees Celsius to positive thirty-five degrees Celsius and start to decrease for temperature above positive thirty-five degrees Celsius. The other device may also include p-type bipolar transistors and resistors to ensure a good robustness against process variations.

The p-type bipolar transistors of the other device may be larger and more susceptible to substrate noise than the CMOS transistors described herein. Moreover, a fine trimming by, for example, metal mask redesign of the circuit may not be possible due to insufficient granularity of the bipolar transistors of the other device.

In contrast, a device of this disclosure may be configured to generate a PWL approximation of an ideal CC electrical current to compensate the temperature-dependent curvature with small residual deviations from the ideal flat behavior. The components in a device of this disclosure may be solely pure CMOS transistors, which are smaller and more immune to substrate noise than bipolar transistors. Moreover, a trimming of the transition points between the different segments of a PWL curve can be easily obtained programming a digital circuit or by means of a metal redesign.

Figure 3:
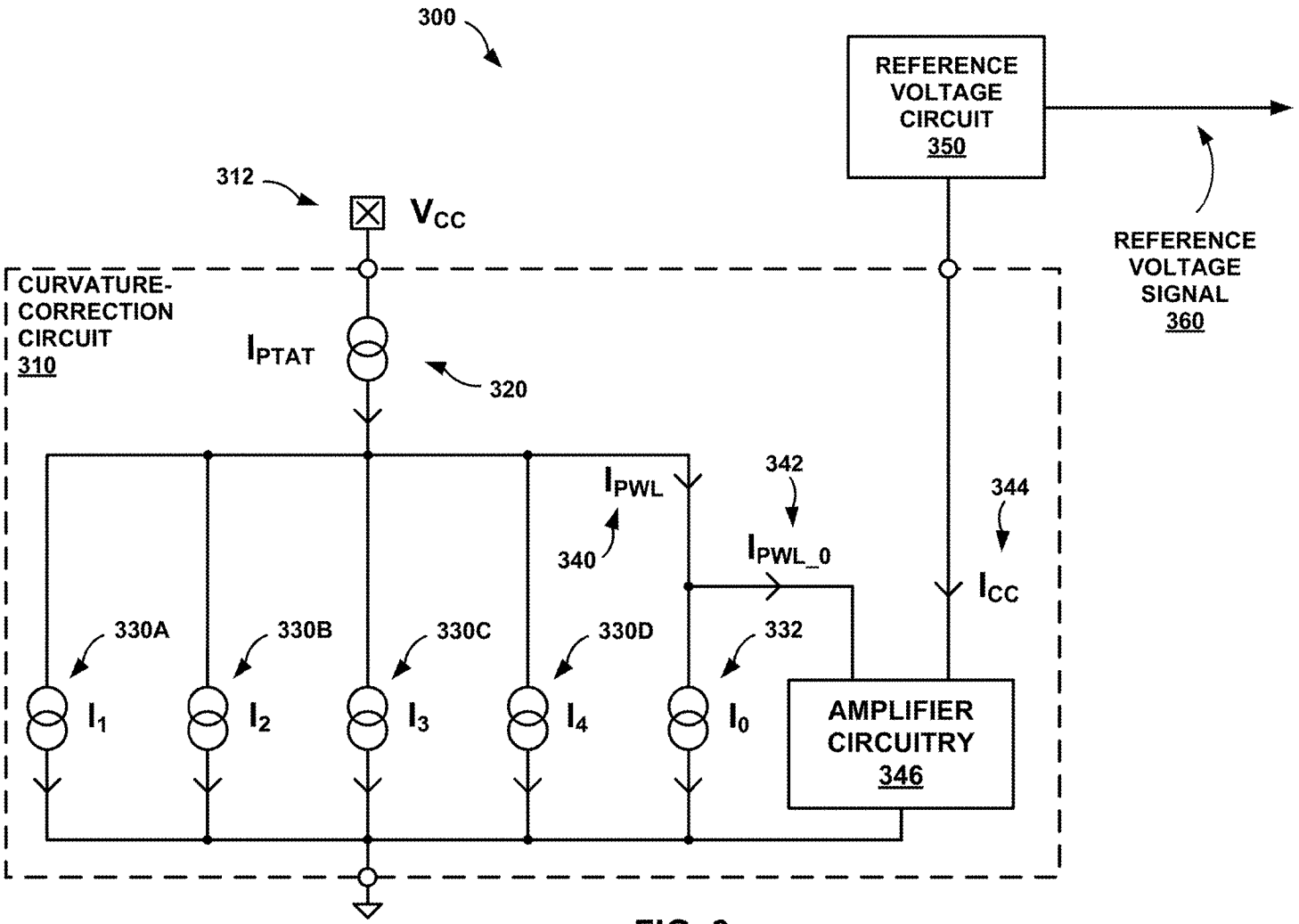
FIG. 3 is a conceptual block and circuit diagram illustrating a curvature-correction circuit, in accordance with some examples of this disclosure.

FIG. 3 is a conceptual block and circuit diagram illustrating a curvature-correction circuit 310, in accordance with some examples of this disclosure. Curvature-correction circuit 310 includes current source 320, current source 332, programmable current sources 330A-330D, and amplifier circuitry 346. In some examples, curvature-correction circuit 310 may any number of programmable current sources, such as three, four, five, and so on.

Current source 320 may be configured to generate a PTAT electrical current (e.g., $I_{PTAT}$) based on electricity received from or supplied to node 312 (VCC). Each of programmable current sources 330A-330D may be configured to generate a respective programmable electrical current (e.g., I1, I2, I3, and I4). Curvature-correction circuit 310 may be configured to generate PWL electrical current 340 by subtracting zero or more of the programmable electrical currents from the PTAT electrical current generated by current source 320.

Curvature-correction circuit 310 may also include three or more switches (not shown in FIG. 3), where each switch is electrically connected in series with one of programmable current sources 330A-330D. Device 300 may include a control circuit (not shown in FIG. 3) configured to operate each switch to enable or disable each of programmable current sources 330A-330D. For example, if the control circuit disables all of the switches of curvature-correction circuit 310, then PWL electrical current 340 may be equal to the PTAT electrical current generated by current source 320 because there will be no active programmable current sources. If the control circuit enables all of the switches, then PWL electrical current 340 may be equal to the PTAT electrical current generated by current source 320 minus all four of the programmable electrical currents (e.g., I1-I4).

Current source 332 may be configured to generate a constant-over-temperature electrical current (e.g., $I_0$). Curvature-correction circuit 310 may be configured to generate offset PWL electrical current 342 (e.g., $I_{PWL_0}$) based on the constant-over-temperature electrical current by subtracting the constant-over-temperature electrical current from PWL electrical current 340. Amplifier circuitry 346 may be configured to generate CC electrical current 344 (e.g., $I_{CC}$) based on offset PWL electrical current 342. Amplifier circuitry 346 may be configured to generate CC electrical current 344 by amplifying or attenuating offset PWL electrical current 342. Amplifier circuitry 346 may include multiplier circuitry or divider circuitry configured to generate CC electrical current 344 at a specific multiple or fraction of offset PWL electrical current 342.

Reference voltage circuit 350 may be configured to generate reference voltage signal 360 based on CC electrical current 344. Reference voltage circuit 350 may be configured to first generate an uncorrected reference voltage signal and then generate reference voltage signal 360 by subtracting CC electrical current 344 from the uncorrected reference voltage signal. Reference voltage circuit 350 may be configured to subtract CC electrical current 344 from the uncorrected reference voltage signal by, for example, conducting CC electrical current 344 through a shunt resistor. The shunt resistor may be connected to a node between a conductor carrying the uncorrected reference voltage signal and a conductor carrying reference voltage signal 360.

Each of programmable current sources 330A-330D may include one or more programmable parameters, such as number, trigger temperature, and slope. A control circuit may be configured to determine the trigger temperature of one of programmable current sources 330A-330D by turning off or disabling the respective programmable current source at temperatures below the trigger temperature. The control circuit may be configured to disable the respective programmable current source by disabling a respective switch at temperatures below the trigger temperature, where the respective switch is connected in series with the respective programmable current source. In some examples, each of programmable current sources 330A-330D may include a different trigger temperature such that there are five temperature intervals.

Figure 4:
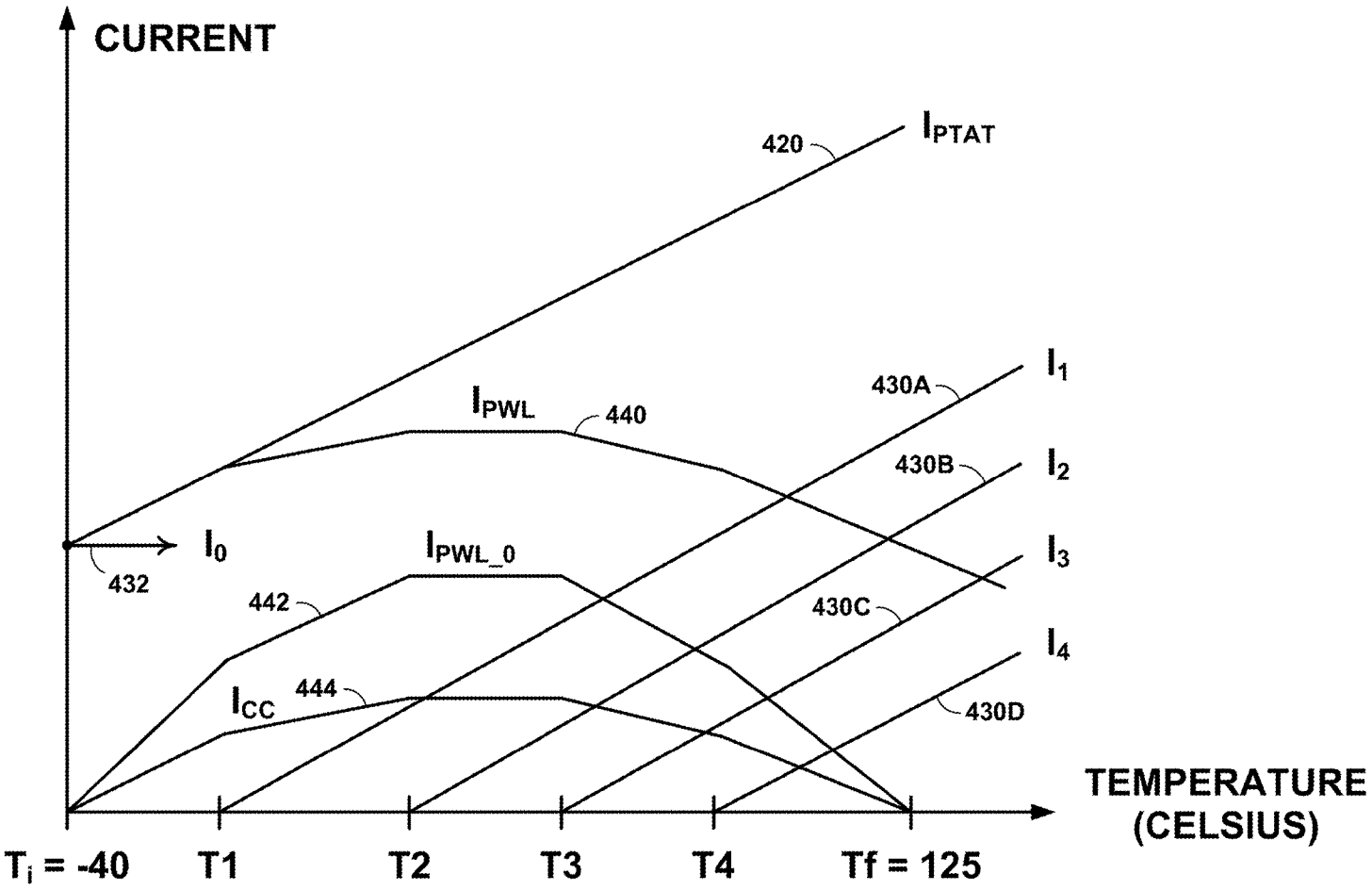
FIG. 4 is a graph of electrical current and temperature for four programmable current sources, in accordance with some examples of this disclosure.

FIG. 4 is a graph of electrical current and temperature for four programmable current sources, in accordance with some examples of this disclosure. At a first temperature interval below the lowest trigger temperature, none of programmable current sources 330A-330D may conduct electricity. Referring to FIG. 4, the first temperature interval may correspond to temperatures below $T_1$ when none of programmable electrical currents 430A-430D are subtracted from PTAT electrical current 420. At a second temperature interval between the lowest trigger temperature and the second-lowest trigger temperature, only one of programmable current sources 330A-330D may conduct electricity. Referring to FIG. 4, the second temperature interval may correspond to temperatures between $T_1$ and $T_2$ when programmable electrical current 430A is subtracted from PTAT electrical current 420. At a third temperature interval between the second-lowest trigger temperature and the second-highest trigger temperature, two of programmable current sources 330A-330D may conduct electricity. Referring to FIG. 4, the third temperature interval may correspond to temperatures between $T_2$ and $T_3$ when programmable electrical currents 430A and 430B are subtracted from PTAT electrical current 420.

At a fourth temperature interval between the second-highest trigger temperature and the highest trigger temperature, three of programmable current sources 330A-330D may conduct electricity. Referring to FIG. 4, the fourth temperature interval may correspond to temperatures between $T_3$ and $T_4$ when programmable electrical currents 430A-430C are subtracted from PTAT electrical current 420. At a fifth temperature interval above the highest trigger temperature, all four of programmable current sources 330A-330D may conduct electricity. Referring to FIG. 4, the fifth temperature interval may correspond to temperatures above $T_4$ when all of programmable electrical currents 430A-430D are subtracted from PTAT electrical current 420. In some examples, there may be more or fewer than four programmable electrical currents in curvature-correction circuit 310.

The electrical-current-to-temperature slope of each of programmable current sources 330A-330D may be programmable. Referring to FIG. 4, the electrical-current-to-temperature slope of any of programmable electrical currents 430A-430D may be programmable. The electrical-current-to-temperature slope of a programmable electrical current may be related to an aspect ratio of the respective programmable current source. A control circuit may adjust the aspect ratio of a programmable current source by selecting the number of active transistors connected in parallel in a current mirror of the programmable current source and/or by selecting the number of active transistors connected in parallel in a current mirror of current source 320 (see FIG. 5). The slope of an electrical current may also be programmable by trimming a current mirror, such as by physically connecting or disconnecting one or more transistors or by programming a control circuit.

The number of programmable current sources 330A-330D may also be programmable. For example, a control circuit may be configured to reduce the number of programmable current sources 330A-330D by disabling (e.g., disconnecting) one or more of programmable current sources 330A-330D. The control circuit may be configured to disable a programmable current source by turning off a switch that is connected in series with the programmable current source and/or by raising the trigger temperature higher than the range of operating temperatures for device 300. For a lower number of programmable current sources 330A-330D, electrical currents 440, 442, and/or 444 may have fewer segments and a coarser fit to the curvature of an uncorrected reference voltage signal. In contrast, for a higher number of programmable current sources 330A-330D, electrical currents 440, 442, and/or 444 may have more segments and a coarser fit to the curvature of the uncorrected reference voltage signal.

In summary, curvature-correction circuit 310 and a control circuit may be configured to change each of programmable electrical current 430A-430D by changing the slope over temperature and by changing each of the trigger temperatures $T_1$, $T_2$, $T_3$, and $T_4$. The trigger temperatures may also be referred to as transition points because the slopes of electrical currents 440, 442, and 444 may change in FIG. 4 at each trigger temperature. The resulting PWL electrical current 440 (e.g., $I_{PWL}$) has a residual offset that can be compensated by subtracting a constant-over-temperature electrical current 432 (e.g., $I_0$). Curvature-correction circuit 310 may be configured to generate offset PWL electrical current 442 as the difference between PWL electrical current 440 and electrical current 432. Amplifier circuitry 346 may be configured to amplify or attenuate offset PWL electrical current 442 to obtain the desired CC electrical current 444. The number of programmable current sources 330A-330D, the temperature coefficients (e.g., slopes), and the starting temperatures (e.g., trigger temperatures) can be adjusted by a control circuit, a designer, a programmer, a one-time programmable (OTP) memory, and/or a reprogrammable memory device (e.g., flash memory).

The parameters of programmable current sources 330A-330D may be programmable at the time of manufacture or in the field during operation of device 300. For example, device 300 may be tested in the factory, and a designer may select or adjust the parameters of programmable current sources 330A-330D based on the test results. Additionally or alternatively, device 300 may be configured to self-test in the field and select or adjust the parameters of programmable current sources 330A-330D based on the self-test results.

Figure 5:
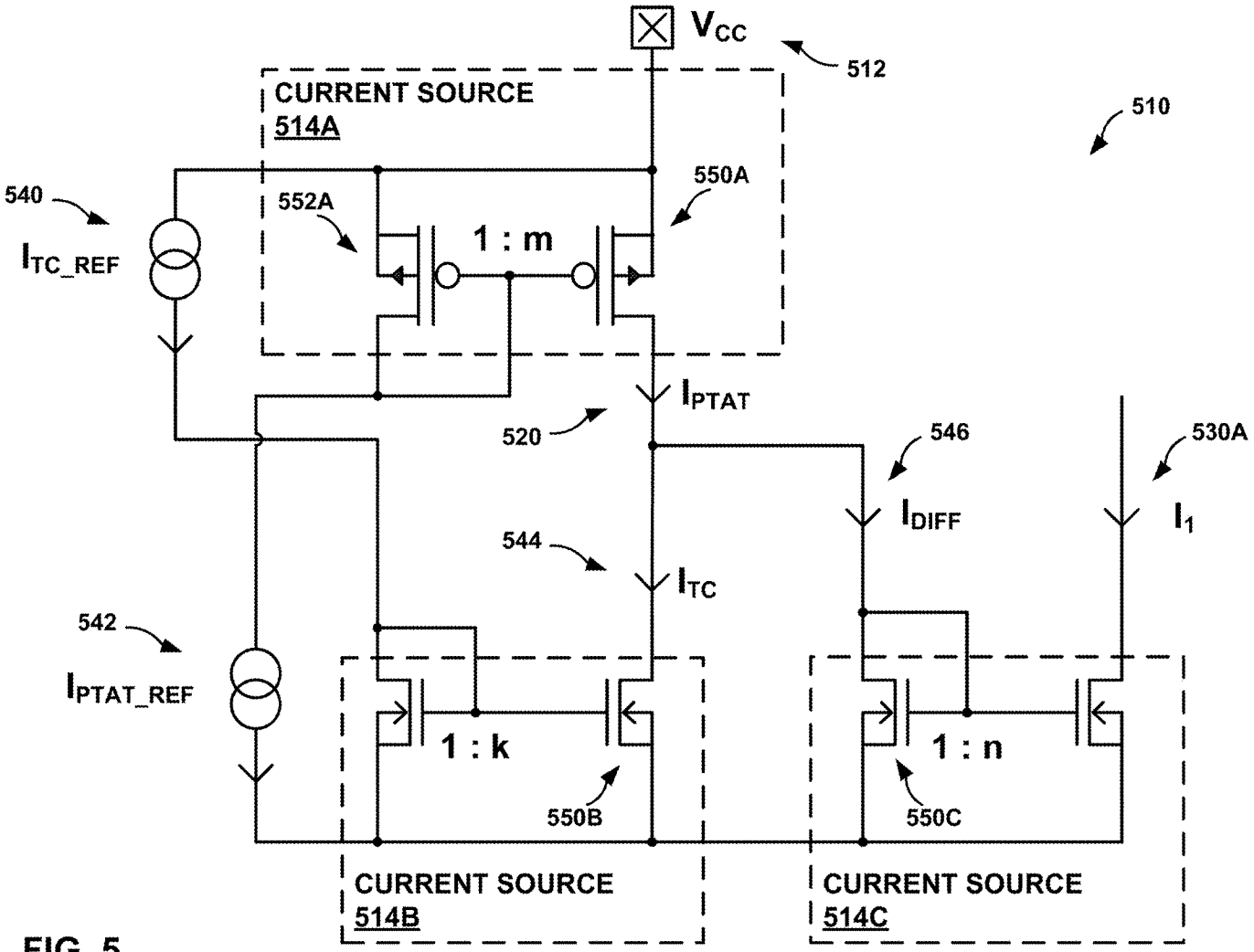
FIG. 5 is a circuit diagram of a curvature-correction circuit, in accordance with some examples of this disclosure.

FIG. 5 is a circuit diagram of a curvature-correction circuit 510, in accordance with some examples of this disclosure. Curvature-correction circuit 510 includes current sources 514A-514C, each including a current mirror. Curvature-correction circuit 510 includes current sources 540 and 542. Practical implementations of this example of curvature-correction 510 may make use of $I_{PTAT}$ current sources that are already available in the bandgap block, where the voltage and resistance are defined by Equation (1). PTAT current sources may employ low-temperature-coefficient polysilicon resistors. Constant-over-temperature current sources (e.g., $I_0$ in FIGS. 3 and 4) can be obtained by applying a bandgap voltage on a low-temperature-coefficient polysilicon resistor. A possible implementation of $I_1$ is depicted in FIG. 5.

$$\frac{\Delta V_{be}}{R} = \frac{kT \times \ln(A1/A2)}{q}, \text{ (where } A1 \text{ and } A2 \text{ are constants)} \quad (1)$$

Current source 514A may be configured to generate PTAT electrical current 520 (e.g., $I_{PTAT}$) based on the aspect ratio of current source 514A (e.g., 1:m) and the electrical currents conducted by current source 540 and 542 (e.g., $I_{TC_REF}$ and $I_{PTAT_REF}$). Curvature-correction circuit 510 may be configured to subtract electrical current 544 (e.g., $I_{TC}$) from electrical current 520. Current source 514B may be configured to generate electrical current 544 (e.g., $I_{TC}$) based on the aspect ratio of current source 514B (e.g., 1:k) and the electrical currents conducted by current sources 540 and 542. Curvature-correction circuit 510 may be configured to mirror the difference of electrical currents 520 and 544, which is electrical current 546 (e.g., $I_{DIFF}$), through current mirror 514C to generate electrical current 530A (e.g., $I_1$).

Curvature-correction circuit 510 may include similar circuit designs configured to other electrical currents, such as $I_2$, $I_3$, and $I_4$.

There are at least two possible ways to generate electrical current 530A. First, a constant-over-temperature electrical current (e.g., electrical current 544) may be subtracted from PTAT electrical current 520. Second, another PTAT electrical current (e.g., electrical current 544) may be subtracted from PTAT electrical current 520.

The trigger temperature $T_1$ can be programmed by changing the aspect ratios of current sources 514A and 514B, thus varying electrical currents 520 and/or 544. The aspect ratio of each of current sources 514A-514C may be individually programmable or trimmable, such that any one of the aspect ratio variables k, m, and n may be changed without changing the other variables. The temperature coefficient of electrical current 530A can be programmed by adjusting the aspect ratio of current source 514C. Possible alternatives to adjusting the aspect ratios of current sources 514A-514C are metal trimming, fuses, OTP trimming, and/or digital algorithms. In some examples, curvature-correction circuit 510 may include one or more switches connected in series with one or more of current sources 514A-514C. A control circuit may be configured to enable each of current sources 514A-514C at a respective trigger temperature.

In some examples, curvature-correction circuit 510 may include only CMOS devices in current sources 514A-514C, instead of bipolar transistors and/or resistors. Curvature-correction circuit 510 may differ from other curvature-correction circuits because current sources 514A-514C may include only CMOS transistors in the current mirrors. Other devices may include bipolar transistors and/or resistors, which may have greater process variation and temperature-dependence.

Figure 6:
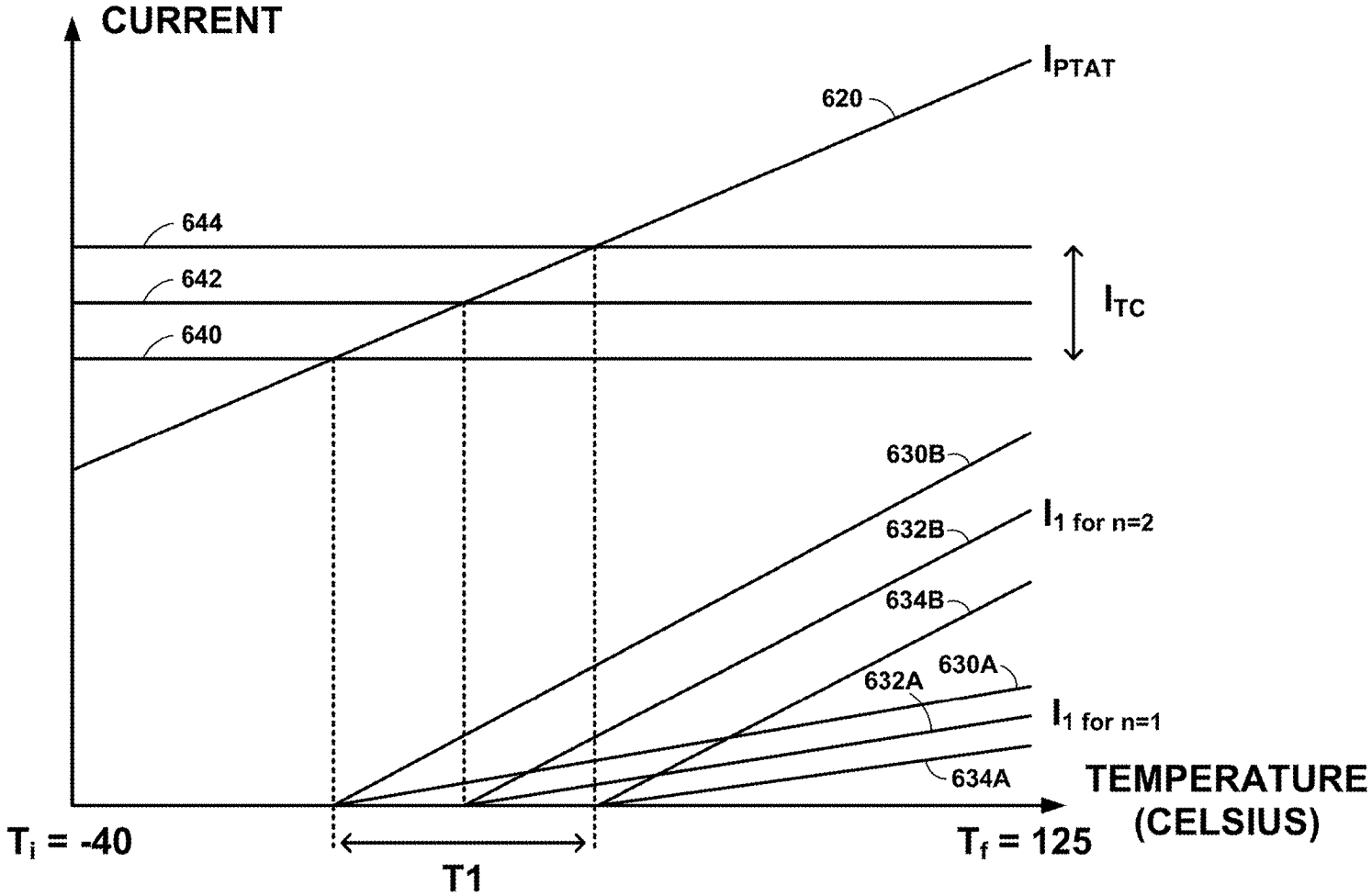
FIG. 6 is a graph of electrical current and temperature for a programmable current source, in accordance with some examples of this disclosure.

FIG. 6 is a graph of electrical current and temperature for a programmable current source, in accordance with some examples of this disclosure. FIG. 6 depicts $I_1$ for three trigger temperatures and two slopes. The trigger temperature for $I_1$ may be based on the amplitude of the temperature-constant electrical current $I_{TC}$ and PTAT electrical current 620. For temperature-constant electrical current 640, programmable electrical current $I_1$ may have slope 630A or 630B, depending on the aspect ratio of current mirror 514C (e.g., "1:n"). For temperature-constant electrical current 642, programmable electrical current $I_1$ may have slope 632A or 632B. For temperature-constant electrical current 644, programmable electrical current $I_1$ may have slope 634A or 634B. A device that is configured to generate $I_1$ in FIG. 6 may also be configured to generate other Ix electrical currents (e.g., $I_2$, $I_3$, and $I_4$) that may be shifted to trigger temperatures that are lower or higher than $T_1$.

Figure 7:
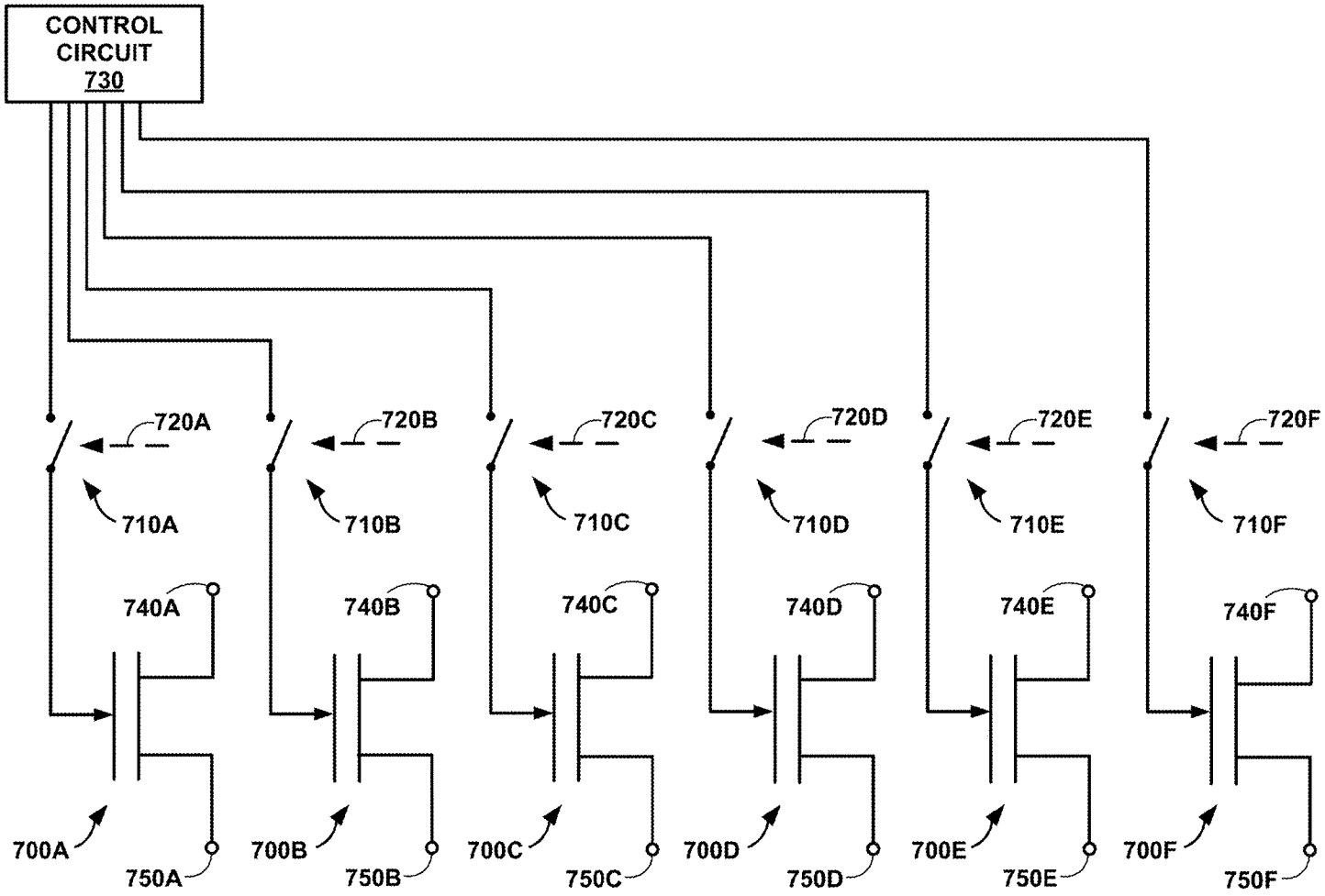
FIG. 7 is a circuit diagram of six transistors configured to be connected in parallel, in accordance with some examples of this disclosure.

FIG. 7 is a circuit diagram of six transistors configured to be connected in parallel, in accordance with some examples of this disclosure. FIG. 7 is an example circuit diagram of a portion of programmable current sources 130A-130N in FIG. 1, programmable current sources 330A-330D in FIG. 3, and current sources 514A-514C in FIG. 5. For example, transistors 700A-700F may be equivalent to one of transistors 550A-550C. Transistors 700A-700F may be n-channel transistors or p-channel transistors, such as n-channel MOS transistors or p-channel MOS transistors. Connected in parallel, transistors 700A-700F may be configured to conduct electricity as a single mirror because the total electrical current through transistors 700A-700F may be the sum of the electrical currents through the active transistors of transistors 700A-700F. In some examples, transistors 700A-700F may connected in parallel because all of high-side terminals 740A-740F are electrically connected to each other, and all of low-side terminals 750A-750F are electrically connected to each other.

For example, transistors 700A-700F may represent transistor 550A in FIG. 5. High-side terminals 740A-740F may be electrically connected to a high-side voltage rail that supplies voltage $V_{CC}$ (e.g., node 512). The control terminals of transistors 700A-700F may be configured to receive control signals from control circuit 730, which may also be delivered to the control terminals of transistors 550A and 552A. For example, if transistors 700A-700F are a part of transistor 550A in FIG. 5, then low-side terminals 750A-750F may be configured to deliver PTAT electrical current 520 to current sources 514B and 514C.

Each of transistors 700A-700F may be configured to conduct electricity in parallel or not conduct electricity in parallel by opening or closing switches 710A-710F. For example, to cause four of transistors 700A-700F to conduct electricity in parallel, signals 720A-720D may close switches 710A-710D, and signals 720E and 720F may open switches 710E and 710F. The aspect ratio of current source 514A may be based on the number of active transistors 700A-700F that are configured to conduct electricity in parallel. Thus, the aspect ratio of current source 514A may be four to one if switches 710A-710D are closed and switches 710E and 710F are open.

One of more of transistors 700A-700F may be configured to conduct electricity in parallel by many other methods. In some examples, the control terminals of transistors 700A-700F may be electrically disconnected from control circuit 730 and electrically connected to a respective one of high-side terminals 740A-740F. To reconnect a transistor, the control terminal of the respective one of transistors 700A-700F may also be electrically connected to control signals 720 and electrically disconnected from a respective one of high-side terminals 740A-740F. Alternatively or additionally, a switch may be placed in series with each of high-side terminals 740A-740F or each of low-side terminals 750A-750F to form a cascode circuit with the respective one of transistors 700A-700F. The switch of each cascode circuit may be opened or closed to connect or disconnect the respective one of transistors 700A-700F. The switch of each cascode circuit may also have its control terminal connected or disconnected from the supply of the current mirror to connect or disconnect the respective one of transistors 700A-700F.

Figure 8:
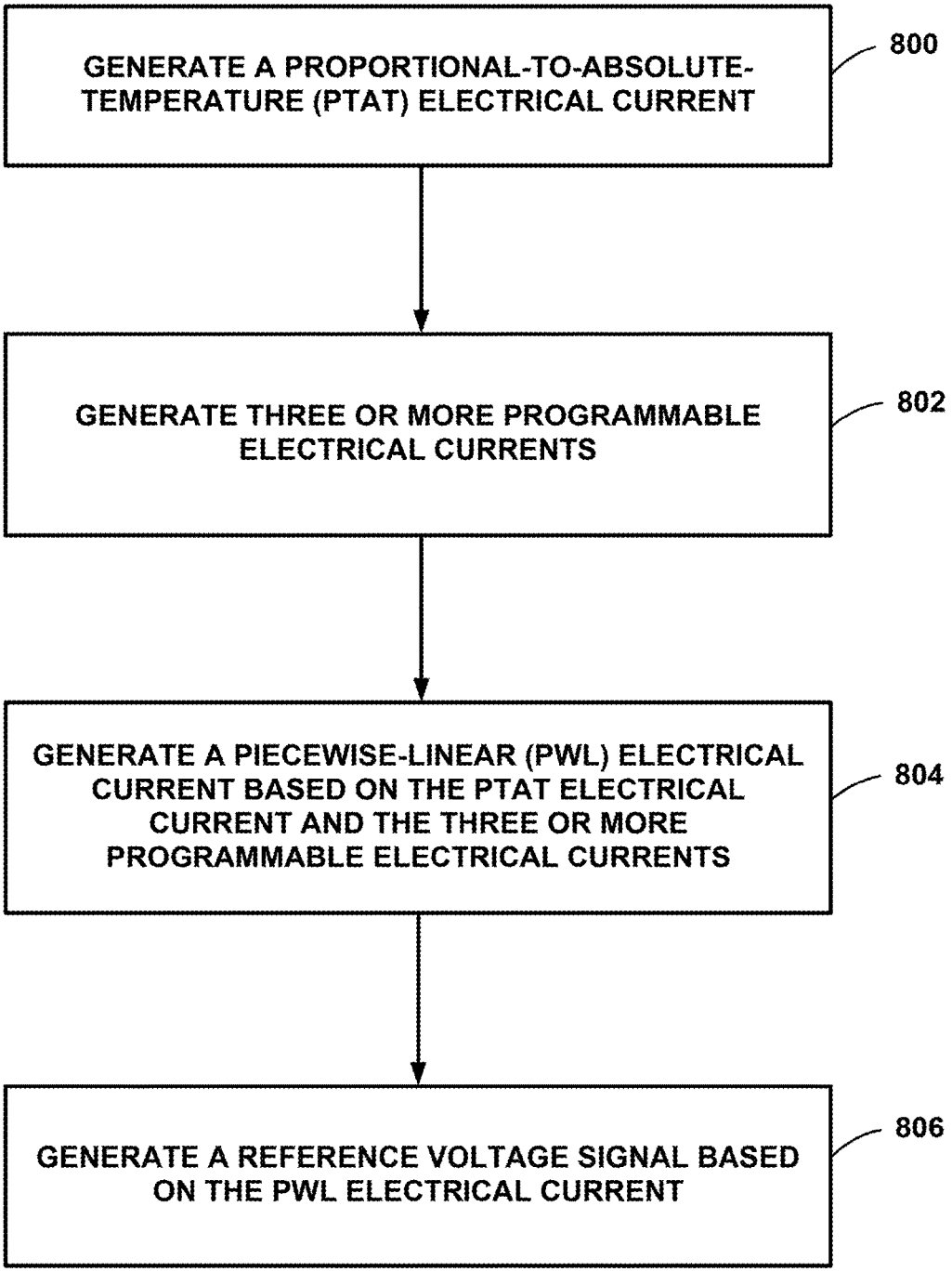
FIGS. 8 and 9 are flowcharts illustrating example techniques for generating a reference voltage signal, in accordance with some examples of this disclosure.
Figure 9:
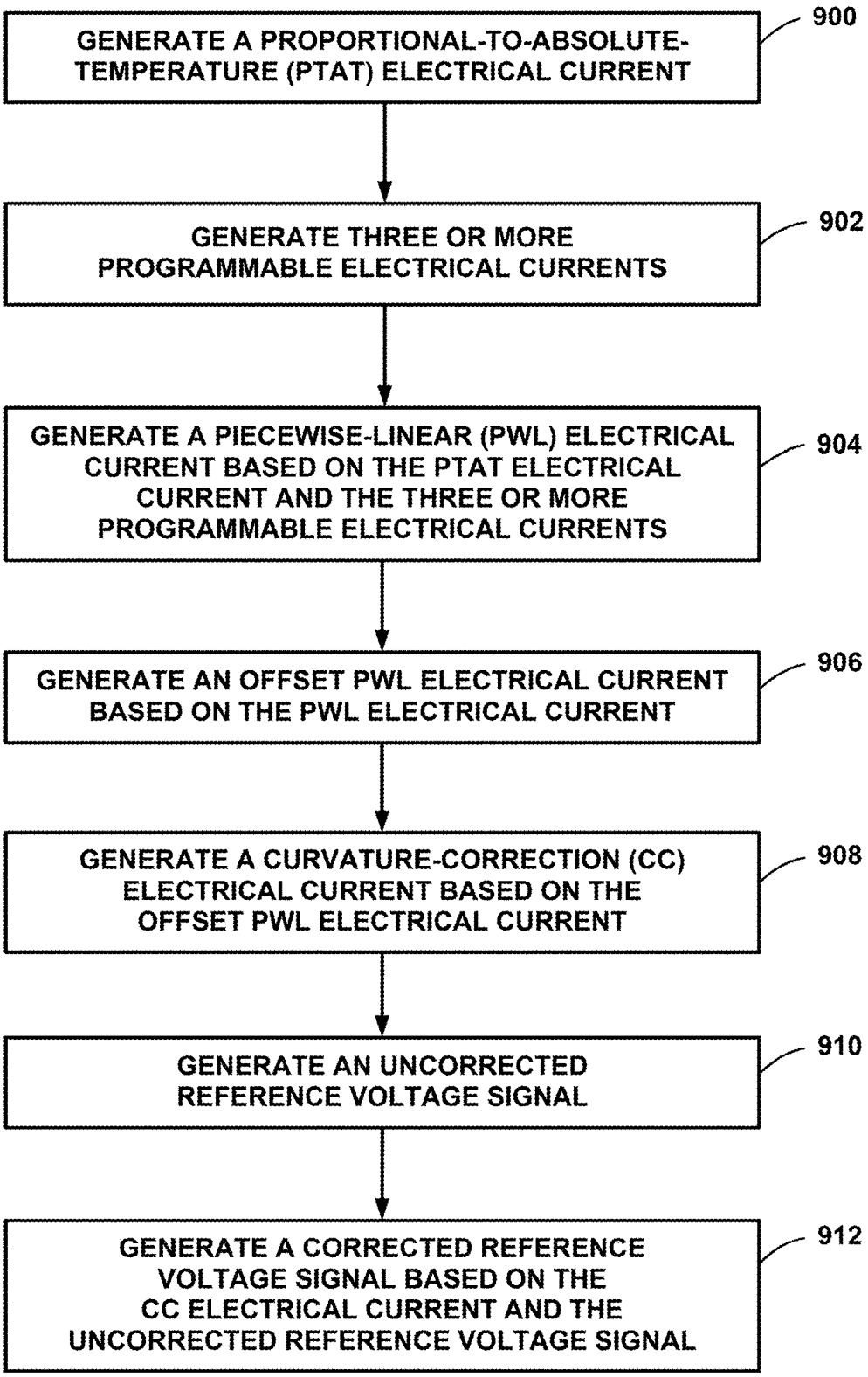

FIGS. 8 and 9 are flowcharts illustrating example techniques for generating a reference voltage signal, in accordance with some examples of this disclosure. The example techniques of FIG. 8 are described with reference to device 100 in FIG. 1, although other components, such as device 300 in FIG. 3 and curvature-correction circuit 510 in FIG. 5, may exemplify similar techniques.

In the example of FIG. 8, current source 120 generates PTAT electrical current 122 (800). Device 100 may be configured to generate an uncorrected reference voltage signal with an electrical-current-to-temperature slope that varies over a range of temperatures, which may be referred to as the temperature-dependent curvature of the uncorrected reference voltage signal. The uncorrected reference voltage signal may be converted to an electrical current by applying the uncorrected reference voltage signal to a resistor (e.g., via Ohm's Law). PTAT electrical current 122 may have a constant electrical-current-to-temperature slope that is approximately equal to the electrical-current-to-temperature of the temperature-dependent curvature of the uncorrected reference voltage signal at relatively low temperatures.

The lowest trigger temperature of programmable current sources 130A-130N may be programmed based on the fit between PTAT electrical current 122 and the uncorrected reference voltage signal at relatively low temperatures, such as below zero degrees Celsius or below negative ten degrees Celsius. In some examples, curvature-correction circuit 110 may include amplifier circuitry to amplify or attenuate the slope of an electrical current before applying the amplified or attenuated electrical current to the uncorrected reference voltage signal.

In the example of FIG. 8, programmable current sources 130A-130N generate three or more programmable electrical currents 132A-132N (802). The parameters of each of programmable current sources 130A-130N may be individually programmable (e.g., trimmable or adjustable). A control circuit of device 100 may be configured to determine when, whether, and at what temperatures to turn on transistors of programmable current sources 130A-130N, which may affect the trigger temperatures and/or the number of programmable current sources 130A-130N. Furthermore, the aspect ratios of programmable current sources 130A-130N may also be programmable, which may affect the trigger temperatures, slopes, and/or the number of programmable current sources 130A-130N.

In the example of FIG. 8, curvature-correction circuit 110 generates PWL electrical current 140 based on PTAT electrical current 122 and three or more programmable electrical currents 130A-130N (804). Curvature-correction circuit 110 may be configured to subtract programmable electrical currents 130A-130N from PTAT electrical current 122 to generate PWL electrical current 140. PWL electrical current 140 may include several segments, where each segment extends across a range of temperatures. The electrical-current-to-temperature slope of each segment of PWL electrical current 140 may be approximately linear. Reference voltage circuit 150 may be configured to generate reference voltage signal 160 with a temperature variation based on the electrical-current-to-temperature slope of the segments of PWL electrical current 140.

In the example of FIG. 8, reference voltage circuit 150 generates reference voltage signal 160 based on PWL electrical current 140 (806). Reference voltage circuit 150 may be configured to conduct PWL electrical current 140 through a resistor to create a PWL voltage signal to subtract from or add to an uncorrected reference voltage signal to generate reference voltage signal 160. Reference voltage signal 160 may have an amplitude that is roughly the same as the average amplitude of the uncorrected reference voltage signal. However, the temperature-dependent variation in the amplitude of reference voltage signal 160 may be much lower than the temperature-dependent variation in the amplitude of the uncorrected reference voltage signal.

The example techniques of FIG. 9 are described with reference to device 300 in FIG. 3, although other components, such as device 100 in FIG. 1 and curvature-correction circuit 510 in FIG. 5, may exemplify similar techniques. In the example of FIG. 9, current source 320 generates a PTAT electrical current (900), and programmable current sources 330A-330D generate programmable electrical currents ($I_1$-$I_4$) (902). In the example of FIG. 9, curvature-correction circuit 310 generates PWL electrical current 340 based on PTAT electrical current generated by current source 320 and the programmable electrical currents generated by current sources 330A-330N (904).

In the example of FIG. 9, curvature-correction circuit 310 generates offset PWL electrical current 342 based on PWL electrical current 340 (906). Current source 332 may be configured to generate a constant-over-temperature electrical current ($I_0$). Curvature-correction circuit 310 may be configured to generate offset PWL electrical current 342 by subtracting the constant-over-temperature electrical current from PWL electrical current 340. Offset PWL electrical current 342 may be a normalized or offset version of PWL electrical current 340.

In the example of FIG. 9, amplifier circuitry 346 generates CC electrical current based on offset PWL electrical current 342 (908). Amplifier circuitry 346 may be configured to generate CC electrical current 344 by amplifying or attenuating offset PWL electrical current 342. In terms of amplitude, CC electrical current 344 may be a compressed or expanded version of offset PWL electrical current 342. Amplifier circuitry 346 may be configured to compress or expand offset PWL electrical current 342 to match the amplitude range of CC electrical current 344 to the amplitude range of the uncorrected reference voltage signal.

In the example of FIG. 9, reference voltage circuit 350 generates an uncorrected reference voltage signal (910). Reference voltage circuit 350 may include a bandgap reference voltage circuit configured to generate the uncorrected reference voltage signal based on the bandgap of a semiconductor material such as silicon or germanium. FIG. 2 illustrates uncorrected reference voltage signal 200 as an example. In the example of FIG. 9, reference voltage circuit 350 generates reference voltage signal 360 based on PWL electrical current 340 (912).

The following numbered examples demonstrate one or more aspects of the disclosure. Each example is described with respect to one or more figures. The reference to one or more figures is not intended to limit the scope of an example to the referenced figures.

Example 1

A device includes a curvature-correction circuit including a first current source configured to generate a PTAT electrical current. The curvature-correction circuit also includes three or more programmable current sources configured to generate three or more programmable electrical currents. The curvature-correction circuit is configured to generate a PWL electrical current based on the PTAT electrical current and the three or more programmable electrical currents. The device also includes a reference voltage circuit configured to generate a reference voltage signal based on the PWL electrical current.

Device 100 of FIG. 1 provides an illustration of example 1. Device 100 includes curvature-correction circuit 110 including current source 120 configured to generate PTAT electrical current 122. Curvature-correction circuit 110 also includes programmable current sources 130A-130N configured to generate programmable electrical currents 132A-132N. Curvature-correction circuit 110 is configured to generate PWL electrical current 140 based on PTAT electrical current 122 and programmable electrical currents 132A-132N. Device 100 also includes reference voltage circuit 150 configured to generate reference voltage signal 160 based on PWL electrical current 140.

Example 2

The device of example 1, wherein each programmable current source of the three or more programmable current sources is configured to generate a respective programmable electrical current of the three or more programmable electrical currents.

Example 3

The device of examples 1-2 or any combination thereof, wherein the curvature-correction circuit is configured to generate the PWL electrical current by at least subtracting the three or more programmable current sources from the PTAT electrical current.

Example 4

The device of examples 1-3 or any combination thereof, wherein the reference voltage signal is a corrected reference voltage signal. The reference voltage circuit is configured to generate the corrected reference voltage signal by at least subtracting the PWL electrical current from an uncorrected reference voltage signal.

Example 5

The device of examples 1-4 or any combination thereof, wherein the curvature-correction circuit further includes a second current source configured to generate a constant-over-temperature electrical current. The curvature-correction circuit is further configured to generate an offset PWL electrical current based on the PWL electrical current and the constant-over-temperature electrical current generated by the second current source. The reference voltage circuit is configured to generate the reference voltage signal based on the offset PWL electrical current.

Device 300 of FIG. 3 provides an illustration of example 5. Curvature-correction circuit 310 includes current source 332 configured to generate a constant-over-temperature electrical current. Curvature-correction circuit 310 is configured to generate offset PWL electrical current 342 based on PWL electrical current 340 and the constant-over-temperature electrical current generated by current source 332. Curvature-correction circuit 310 may be configured to generate offset PWL electrical current 342 by subtracting the constant-over-temperature electrical current from PWL electrical current 340. Reference voltage circuit 350 is configured to generate reference voltage signal 360 based on offset PWL electrical current 342.

Example 6

The device of examples 1-5 or any combination thereof, wherein the curvature-correction circuit is configured to generate the offset PWL electrical current by at least subtracting the constant-over-temperature electrical current from the PWL electrical current.

Example 7

The device of examples 1-6 or any combination thereof, wherein the reference voltage signal is a corrected reference voltage signal. The reference voltage circuit is configured to generate the corrected reference voltage signal by at least subtracting the offset PWL electrical current from an uncorrected reference voltage signal.

Example 8

The device of examples 1-7 or any combination thereof, wherein the curvature curvature-correction circuit further includes an amplifier circuit configured to generate a CC electrical current based on the offset PWL electrical current. The reference voltage circuit is configured to generate the reference voltage signal based on the CC electrical current.

Device 300 of FIG. 3 provides an illustration of example 8. Curvature-correction circuit 310 includes amplifier circuit 346 configured to generate CC electrical current 344 based on offset PWL electrical current 342. Amplifier circuit 346 may include a current mirror that amplifies or attenuates offset PWL electrical current 342 to generate CC electrical current 344. Reference voltage circuit 350 is configured to generate reference voltage signal 360 based on CC electrical current 344. Reference voltage signal 360 may also be based on an uncorrected reference voltage signal.

Example 9

The device of examples 1-8 or any combination thereof, wherein the amplifier circuit is configured to generate the CC electrical current by at least amplifying or attenuating the offset PWL electrical current.

Example 10

The device of examples 1-9 or any combination thereof, wherein the reference voltage signal is a corrected reference voltage signal. The reference voltage circuit is configured to generate the corrected reference voltage signal by at least subtracting the CC electrical current from an uncorrected reference voltage signal.

Example 11

The device of examples 1-10 or any combination thereof, wherein a trigger temperature of each programmable current source of the three or more programmable current sources is programmable.

Example 12

The device of examples 1-11 or any combination thereof, further including a control circuit configured to turn off each respective programmable current source of the three or more programmable current sources at temperatures below a respective trigger temperature of the respective programmable current source.

The graph of FIG. 4 provides an illustration of example 12. The control circuit may be configured to turn off a first programmable current source below temperature $T_1$, a second programmable current source below temperature $T_2$, a third programmable current source below temperature $T_3$, and a fourth programmable current source below temperature $T_4$. The trigger temperatures may define the breakpoints in electrical currents 440, 442, and 444, or the transition temperatures for the segments of electrical currents 440, 442, and 444. Each of electrical currents 440, 442, and 444 may be defined as a PWL electrical current because each electrical current includes continuous linear segments in FIG. 4.

Example 13

The device of examples 1-12 or any combination thereof, wherein the curvature-correction circuit further includes three or more switches. Each switch of the three or more switches is electrically connected in series with a respective programmable current source of the three or more programmable current sources. The control circuit is configured to turn off a programmable current source of the three or more programmable current sources by at least disabling a respective switch of the three or more switches below the respective trigger temperature.

Example 14

The device of examples 1-13 or any combination thereof, wherein an electrical-current-to-temperature slope of each programmable current source of the three or more programmable current sources is programmable.

Example 15

The device of examples 1-14 or any combination thereof, wherein an electrical-current-to-temperature slope of a respective programmable current source of the three or more programmable current sources is programmable by adjusting an aspect ratio of the respective programmable current source.

Example 16

The device of examples 1-15 or any combination thereof, wherein the first current source includes a current mirror, and each programmable current source of the three or more programmable current sources includes a current mirror. The electrical-current-to-temperature slope of a respective programmable current source of the three or more programmable current sources is programmable by at least selecting a number of active transistors connected in parallel in the current mirror of the first current source or selecting a number of active transistors connected in parallel in the current mirror of the respective programmable current source.

Example 17

The device of examples 1-16 or any combination thereof, wherein a number of active programmable current sources of the three or more programmable current sources is programmable.

Example 18

The device of examples 1-17 or any combination thereof, further including a control circuit configured to select the number of active programmable current sources by at least connecting or disconnecting each programmable current source of the three or more programmable current sources to the first current source.

Example 19

The device of examples 1-18 or any combination thereof, wherein the number of active programmable current sources is a number of programmable current sources of the three or more programmable current sources that are connected to the first current source.

Example 20

The device of examples 1-19 or any combination thereof, wherein the first current source includes a current mirror including MOS transistors, and each programmable current source of the three or more programmable current sources includes a current mirror including MOS transistors.

Example 21

The device of examples 1-20 or any combination thereof, wherein each programmable current source of the three or more programmable current sources is configured to generate a programmable PTAT electrical current.

Example 22

The device of examples 1-21 or any combination thereof, wherein each programmable current source of the three or more programmable current sources is configured to generate a programmable constant-over-temperature electrical current.

Example 23

A method includes generating a PTAT electrical current and generating three or more programmable electrical currents. The method further includes generating a PWL electrical current based on the PTAT electrical current and the three or more programmable electrical currents. The method also includes generating a reference voltage signal based on the PWL electrical current.

Example 24

The method of example 23, further including generating a constant-over-temperature electrical current and generating an offset PWL electrical current based on the PWL electrical current and the constant-over-temperature electrical current. In addition, generating the reference voltage signal is further based on the offset PWL electrical current.

Example 25

The method of examples 23-24 or any combination thereof, further including generating a CC electrical current based on the offset PWL electrical current, wherein generating the reference voltage signal is further based on the CC electrical current.

Example 26

The method of examples 23-25 or any combination thereof, wherein generating the reference voltage signal includes subtracting the CC electrical current from an uncorrected reference voltage signal.

Example 27

The method of examples 23-26 or any combination thereof, further including disconnecting each respective programmable electrical current of the three or more programmable electrical currents at temperatures below a respective trigger temperature.

Example 28

A device includes a curvature-correction circuit including a first current source configured to generate a PTAT electrical current and three or more programmable current sources configured to generate three or more programmable electrical currents. The curvature-correction circuit also includes three or more switches, wherein each switch of the three or more switches is electrically connected in series with a respective programmable current source of the three or more programmable current sources. The curvature-correction circuit is configured to generate a piecewise-linear (PWL) electrical current based on the PTAT electrical current and the three or more programmable electrical currents. The device also includes a reference voltage circuit configured to generate a reference voltage signal based on the PWL electrical current. The device further includes a control circuit configured to turn off each programmable current source of the three or more programmable current sources by at least disabling a respective switch of the three or more switches below a trigger temperature for the respective programmable current source. The trigger temperature of each programmable current source of the three or more programmable current sources is programmable.

Example 29

The device of example 28, wherein the first current source includes a current mirror, and each programmable current source of the three or more programmable current sources includes a current mirror. The electrical-current-to-temperature slope of a respective programmable current source of the three or more programmable current sources is programmable by at least selecting a number of active transistors connected in parallel in the current mirror of the first current source or selecting a number of active transistors connected in parallel in the current mirror of the respective programmable current source.

Example 30

The device of examples 28-29 or any combination thereof, wherein the control circuit is further configured to select a number of active programmable current sources by at least connecting or disconnecting each programmable current source of the three or more programmable current sources to the first current source.

Example 31

The device of examples 28-30 or any combination thereof, wherein the first current source includes a current mirror including MOS transistors, and each programmable current source of the three or more programmable current sources includes a current mirror including MOS transistors.

Various examples of the disclosure have been described. Any combination of the described systems, operations, or functions is contemplated. These and other examples are within the scope of the following claims.

What is claimed is:

1. A device comprising:

a curvature-correction circuit including:

a first current source configured to generate a proportional-to-absolute-temperature (PTAT) electrical current;

a second current source configured to generate a constant-over-temperature electrical current; and three or more programmable current sources configured to generate three or more programmable electrical currents, wherein the curvature-correction circuit is further configured to:

generate a piecewise-linear (PWL) electrical current based on the PTAT electrical current and the three or more programmable electrical currents; and generate an offset PWL electrical current based on the PWL electrical current and the constant-over-temperature electrical current; and a reference voltage circuit configured to generate a reference voltage signal based on the offset PWL electrical current.

2. The device of claim 1, wherein the curvature-correction circuit further includes an amplifier circuit configured to generate a curvature-correction (CC) electrical current based on the offset PWL electrical current, and wherein the reference voltage circuit is configured to generate the reference voltage signal based on the CC electrical current.

3. The device of claim 2, wherein the reference voltage signal is a corrected reference voltage signal, and wherein the reference voltage circuit is configured to generate the corrected reference voltage signal by at least subtracting the CC electrical current from an uncorrected reference voltage signal.

4. The device of claim 1, wherein a trigger temperature of each programmable current source of the three or more programmable current sources is programmable.

5. The device of claim 4, further comprising a control circuit configured to turn off each respective programmable current source of the three or more programmable current sources at temperatures below a respective trigger temperature of the respective programmable current source.

6. The device of claim 1, wherein an electrical-current-to-temperature slope of each programmable current source of the three or more programmable current sources is programmable.

7. The device of claim 6, wherein the first current source includes a current mirror, wherein each programmable current source of the three or more programmable current sources includes a current mirror, and wherein the electrical-current-to-temperature slope of a respective programmable current source of the three or more programmable current sources is programmable by at least:

selecting a number of active transistors connected in parallel in the current mirror of the first current source, or selecting a number of active transistors connected in parallel in the current mirror of the respective programmable current source.

8. The device of claim 1, wherein a number of active programmable current sources of the three or more programmable current sources is programmable.

9. The device of claim 8, further comprising a control circuit configured to select the number of active programmable current sources by at least connecting or disconnecting each programmable current source of the three or more programmable current sources to the first current source.

10. The device of claim 1, wherein the first current source includes a current mirror including metal-oxide-semiconductor (MOS) transistors, and wherein each programmable current source of the three or more programmable current sources includes a current mirror including MOS transistors.

11. The device of claim 1, wherein each programmable current source of the three or more programmable current sources is configured to generate a programmable PTAT electrical current.

12. A method comprising:

generating a proportional-to-absolute-temperature (PTAT) electrical current;

generating a constant-over-temperature electrical current;

generating three or more programmable electrical currents;

generating a piecewise-linear (PWL) electrical current based on the PTAT electrical current and the three or more programmable electrical currents;

generating an offset PWL electrical current based on the PWL electrical current and the constant-over-temperature electrical current; and generating a reference voltage signal based on the offset PWL electrical current.

13. The method of claim 12, further comprising generating a curvature-correction (CC) electrical current based on the offset PWL electrical current, wherein generating the reference voltage signal comprises subtracting the CC electrical current from an uncorrected reference voltage signal.

14. The method of claim 12, further comprising disconnecting each respective programmable electrical current of the three or more programmable electrical currents at temperatures below a respective trigger temperature.

15. A device comprising:

a curvature-correction circuit including:

a first current source configured to generate a proportional-to-absolute-temperature (PTAT) electrical current; and three or more programmable current sources configured to generate three or more programmable electrical currents, wherein an electrical-current-to-temperature slope of each programmable current source of the three or more programmable current sources is programmable, and wherein the curvature-correction circuit is further configured to generate a piecewise-linear (PWL) electrical current based on the PTAT electrical current and the three or more programmable electrical currents; and a reference voltage circuit configured to generate a reference voltage signal based on the PWL electrical current.

16. The device of claim 15, further comprising a control circuit configured to select the number of active programmable current sources by at least connecting or disconnecting each programmable current source of the three or more programmable current sources to the first current source.

17. The device of claim 15, wherein a trigger temperature of each programmable current source of the three or more programmable current sources is programmable.

18. A device comprising:

a curvature-correction circuit including:

a first current source configured to generate a proportional-to-absolute-temperature (PTAT) electrical current; and three or more programmable current sources configured to generate three or more programmable electrical currents, wherein the curvature-correction circuit is further configured to generate a piecewise-linear (PWL) electrical current based on the PTAT electrical current and the three or more programmable electrical currents;

a control circuit configured to select a number of active programmable current sources by at least connecting or disconnecting each programmable current source of the three or more programmable current sources to the first current source; and a reference voltage circuit configured to generate a reference voltage signal based on the PWL electrical current.

19. The device of claim 18, wherein the control circuit is configured to determine a trigger temperature of a first programmable current source of the three or more programmable current sources by turning off the first programmable current source at temperatures below the trigger temperature.

20. A device comprising:

a curvature-correction circuit including:

a first current source configured to generate a first proportional-to-absolute-temperature (PTAT) electrical current; and three or more programmable current sources, wherein each programmable current source of the three or more programmable current sources is configured to generate a programmable PTAT electrical current, wherein the curvature-correction circuit is further configured to generate a piecewise-linear (PWL) electrical current based on the PTAT electrical current and the three or more programmable electrical currents; and a reference voltage circuit configured to generate a reference voltage signal based on the PWL electrical current.

* * * * *